US009802134B2

(12) United States Patent
Cai

(10) Patent No.: US 9,802,134 B2
(45) Date of Patent: Oct. 31, 2017

(54) AUTOMATIC DETACHABLE COMBINED TOY GYRO

(71) Applicants: Guangdong Alpha Animation & Culture Co., Ltd., Shantou (CN); Guangdong Auldey Animation & Toy Co., Ltd., Guangzhou (CN); Guangzhou Alpha Culture Communications Co., Ltd., Guangzhou (CN)

(72) Inventor: Dongqing Cai, Shantou (CN)

(73) Assignees: Guangdong Alpha Animation & Culture Co., Ltd. (CN); Guangdong Auldey Animation & Toy Co., Ltd. (CN); Guangzhou Alpha Culture Communications Co., Ltd. (CN)

( * ) Notice: Subject to any disclaimer, the term of this patent is extended or adjusted under 35 U.S.C. 154(b) by 48 days.

(21) Appl. No.: 14/784,432

(22) PCT Filed: Apr. 3, 2015

(86) PCT No.: PCT/CN2015/075901
§ 371 (c)(1),
(2) Date: Oct. 14, 2015

(87) PCT Pub. No.: WO2016/026302
PCT Pub. Date: Feb. 25, 2016

(65) Prior Publication Data

US 2016/0228777 A1 Aug. 11, 2016

(30) Foreign Application Priority Data

Aug. 16, 2014 (CN) ..... 2014 1 0402522

(51) Int. Cl.
*A63H 1/00* (2006.01)
*A63H 1/18* (2006.01)
*A63H 1/02* (2006.01)

(52) U.S. Cl.
CPC ..... *A63H 1/18* (2013.01); *A63H 1/02* (2013.01)

(58) Field of Classification Search
CPC ..... A63H 1/00; A63H 1/18
See application file for complete search history.

(56) References Cited

U.S. PATENT DOCUMENTS 1,783,627 A * 12/1930 Raimondi ..... A63H 1/00 446/256
1,985,657 A 12/1934 Gustine
(Continued)

FOREIGN PATENT DOCUMENTS

CN 102371071 A 3/2012
CN 202315281 U 7/2012
(Continued)

OTHER PUBLICATIONS

Machine translation of CN 202983179 U.*
(Continued)

*Primary Examiner* — Aarti B Berdichevsky
*Assistant Examiner* — Urszula M Cegielnik
(74) *Attorney, Agent, or Firm* — Lerner, David, Littenberg, Krumholz & Mentlik, LLP

(57) ABSTRACT

An automatic detachable combined toy gyro is characterized in that: the gyro is formed by vertically jointing at least two gyros, and tips of the gyros are all elastic tips, so that an upper gyro in the gyros automatically releases the connection with a lower gyro when it is impacted or the rotation thereof is blocked during rotation, and the upper gyro is ejected under the action of the elastic tip to form two
(Continued)

separately rotating gyros. During playing of the present invention, the gyro may be split into two or three gyros during a confrontational match, which greatly increases the aggressiveness of the gyro and obtain a higher win rate; moreover, because the tip of the gyro is an elastic tip, during splitting and separating when playing, the upper gyro is generally split by the elasticity of the tip thereof, and has little impact on the lower gyro.

19 Claims, 5 Drawing Sheets

(56) References Cited

U.S. PATENT DOCUMENTS

| | | | | |
|---|---|---|---|---|
| 3,108,395 | A | 10/1963 | Goldfarb | |
| 4,772,241 | A * | 9/1988 | Bro | A63H 1/20 446/202 |
| 5,205,773 | A * | 4/1993 | Koepcke | A63H 3/06 124/64 |
| 5,941,753 | A | 8/1999 | Diresta | |
| 6,364,734 | B1 | 4/2002 | Ng | |
| 6,443,801 | B1 * | 9/2002 | Bell | A63H 1/00 446/236 |
| 2014/0302743 | A1 | 10/2014 | Cai | |

FOREIGN PATENT DOCUMENTS

| | | | |
|---|---|---|---|
| CN | 202983179 | U * | 6/2013 |
| CN | 203540045 | U | 4/2014 |
| CN | 104174169 | A | 12/2014 |
| CN | 204073389 | U | 1/2015 |
| GB | 1181333 | A | 2/1970 |
| JP | 3083443 | U | 1/2002 |
| JP | 2005328976 | A | 12/2005 |
| WO | 2013078896 | A1 | 6/2013 |

OTHER PUBLICATIONS

International Search Report for Application No. PCT/CN2015075901 dated Jun. 25, 2015.

Extended European Search Report for Application No. 15766039.0 dated Feb. 24, 2017.

* cited by examiner

AUTOMATIC DETACHABLE COMBINED TOY GYRO

CROSS-REFERENCE TO RELATED APPLICATIONS

The present application is a national phase entry under 35 U.S.C §371 of International Application No. PCT/CN2015/075901 filed Apr. 3, 2015, which claims priority from Chinese Application No. 201410402522.4 filed Aug. 16, 2014, all of which are incorporated herein by reference.

TECHNICAL FIELD

The present invention relates to the field of toy, and in particular, to an automatic detachable combined toy gyro.

BACKGROUND

A conventional toy gyro is basically formed by a single gyro including an axis body, a cover, a blade, and a tip. By connecting a gyro ejector and the cover, the gyro is ejected out to rotate. In order to increase or change the performance of the gyro so that the own gyro can surpass the opposite side in a match, most conventional toy gyros are designed to be capable of being assembled and enhanced, for example, the axis body may be designed to be additionally elongated, so that the gyro may be detached to replace or add accessories. However, no matter how to be improved and strengthened, the toy gyro merely performs rotational confrontation as one gyro during playing, and the win rate can hardly be greatly improved. Moreover, the detachable assembly of a toy gyro has been very popular, and therefore, such a gyro gradually losses the novelty, and can hardly be favored by players for a long time. Although a detachable combined toy gyro is invented, it has the following defects: first, a main gyro is ejected by an assistant gyro disposed there under, and in this way, not only a spring must have a large elasticity, the service life is short, but also a lower tip of the upper gyro is easily damaged after being ejected and the rotation stability of the assistant gyro is affected due to the large elasticity; second, the assistant gyro has an incomplete structure, and cannot be ejected separately as a gyro to play, and can only be attached to the main gyro for use; third, for the gyro, an axis body is locked to a gyro ring mainly by using a cover, so that when the cover is removed, the gyro ring is separated from the axis body, and it is hard to be used in the conventional combined gyro, the assembling is inconvenient, and requirements of mass consumers cannot be met.

SUMMARY

An objective of the present invention is: directed to the above mentioned problems and defects, providing an automatic detachable combined toy gyro that can be automatically separated into two or more during playing, can effectively improve the win rate of confrontation and improve interestingness of playing, and has a stable structure, stable rotation and a long service life.

On the basis of this, a further objective of the present invention is to provide an automatic detachable combined toy gyro, including upper and lower gyros that have the same structure, can be combined for playing, can also be ejected separately for playing, and are convenient in assembling.

On the basis of this, a still further objective of the present invention is to provide an automatic detachable combined toy gyro, in which after a cover is removed, a gyro body is still stably combined with an axis body, and assembling is more convenient and faster during multi-gyro combination.

The technical solution of the present invention is implemented as follows:

The automatic detachable combined toy gyro of the present invention is characterized in that: the gyro is formed by vertically jointing at least two gyros, and tips of the gyros are all elastic tips, so that an upper gyro in the gyros automatically releases the connection with a lower gyro when it is impacted or rotation thereof is blocked during rotation, and the upper gyro is ejected under the action of the elastic tip to form two separately rotating gyros.

The present invention is generally formed by jointing two gyros. Definitely, multiple gyros may be overlapped sequentially according to a requirement. A preferred solution is two.

In order that the gyro in the present invention can be ejected separately for playing, and also it is convenient to combine two or more gyros in an overlapping manner, the gyros generally select the same structure. An upper end of the axis body of each gyro is provided with a detachable cover, each cover is provided with a connection structure fitting an ejector, and each gyro can be ejected separately by the ejector for playing by using cooperation of the connection structure on the cover and the ejector. In this way, even a consumer purchases merely one gyro, it is also valuable, and it is unnecessary to purchase the whole combined gyro; likewise, by purchasing one more gyro and removing one cover thereof to perform free combination of the two gyros, the combined gyro has a function of being split and separated after being impacted, so that it is more interesting, and has stronger aggressivity and higher win rate during confrontational playing, thereby having more selections.

Each gyro includes an axis body and a gyro ring sleeved on the axis body. The elastic tip is connected under the axis body, and the elastic tip on the upper gyro is in a compressed state when the upper gyro is connected to the lower gyro. To implement more convenient disconnection of the two gyros when they are impacted and blocked after the connection, the upper gyro and the lower gyro are connected into one piece in a manner that they can be separated rotatably. Moreover, there may be various connection manners between the two gyros, for example, the upper gyro and the lower gyro are jointed by using rotational clamping structures disposed on two gyro rings; or the upper gyro and the lower gyro are jointed by fitting and clamping of the two axis bodies.

In order that the present invention can form gyros having different shape structures or gyros having different heights of the center of gravity (when the center of gravity is low, the gyro has a strong endurance; and when the center of gravity is high, the gyro can perform top attack) by assembling in different directions during use, so that the user can select different attack manners according to the characteristic of the gyro of the opposite side, the direction in which the gyro ring is mounted on the axis body may be turned over vertically.

To implement simpler structure of the present invention, the elastic tip is formed by a tip body connected to a lower end of the axis body and provided with a spring seat in an inner cavity thereof, and a spring disposed on the spring seat in the inner cavity of the tip body, where an upper end of the spring presses against the axis body, and when the upper gyro is connected to the lower gyro, the spring of the elastic tip is compressed and retracted into the axis body together with the upper tip body.

To ensure that the combination of the gyro body and the axis body is still stable after the cover of the lower gyro is removed, a locking structure that can be disposed to fit an outer wall of the axis body may be disposed on the gyro ring. To implement simpler structure and more convenient operation, the locking structure is generally a protrusion disposed on an inner wall of the gyro ring. The axis body includes an axis sleeve and a clamp ring rotatably disposed on the axis sleeve, and the clamp ring is provided with pins extending out of the axis sleeve. An outer wall of the axis sleeve is correspondingly provided with guide slots that can be penetrated by the pins for horizontal rotation, and block structures for the protrusions of the gyro ring to slide in and implementing reliable connection of the gyro ring and the axis sleeve with the pressing of the pins. The elastic tip is connected to a lower portion of the axis sleeve in a vertically movable manner.

In the present invention, the gyro is designed to be formed by jointing and combining at least two gyros, and a tip of each gyro adopts an elastic tip structure, so that during playing, the upper gyro is movably connected to the upper portion of the lower gyro, the elastic tip is pressed, and therefore, when the upper gyro in the gyros is impacted or rotation thereof is blocked during rotation, the upper gyro automatically releases the connection with the lower gyro, and is ejected under the action of the own elastic tip to form two separately rotating gyros, thereby implementing that the gyro can be split into two or three gyros during a confrontation match, which greatly increases the aggressivity of the gyro to increase the win rate, and also has a novel playing method, which is extremely interesting and can get favorites of more players. Moreover, because the tip of the gyro is an elastic tip, during splitting and separating when playing, the upper gyro is generally split by the elasticity of the tip thereof, and has little impact on the lower gyro; in addition, when falling to the ground, the upper gyro may implement soft landing by using the buffer effect of the elasticity, so as to effectively protect the tip and maintain the stability of the rotation. Meanwhile, the elastic tip of the lower gyro also provides a buffer effect for the gyro, so as to prevent the impact influence and the over-heavy gyro from damaging the tip and improve the stability of the gyro; therefore, the structure is reliable, the rotation is stable, the service life is long, and the problems of the conventional toy gyro that merely one gyro is used for rotational confrontation during playing so that the win rate is low and it is less interesting, and that the gyro is instable in rotation after splitting and has a short service life, and the like are effectively solved. In addition, the present invention adopts the locking structure that is disposed on the gyro ring and can be fitted with the outer wall of the axis body, so that after the cover of the gyro is removed, the gyro body can still be reliably combined with the axis body, and the assembly is more convenient and faster. The present invention further adopts a structure in which the direction of mounting the gyro ring on the axis body may be turned over vertically, the user can form different heights of center of gravity of the gyro by assembling in different directions, so that the user can select different assembling manners for attack according to the characteristic of the gyro of the opposite side, thereby further increasing the interestingness of playing. In the present invention, two or more gyros are skillfully combined into one piece, and separation is implemented by confrontation and impact, so that the game is extremely interesting, and a player can gain a higher win rate during a match; meanwhile the operational ability and competitiveness of children may be trained, and the gyro has a reliable structure, stable rotation, and a long service life, thereby having a broad market prospective.

The present invention is further described through the following accompanying drawings.

DETAILED DESCRIPTION OF THE PREFERRED EMBODIMENTS

Figure 1:
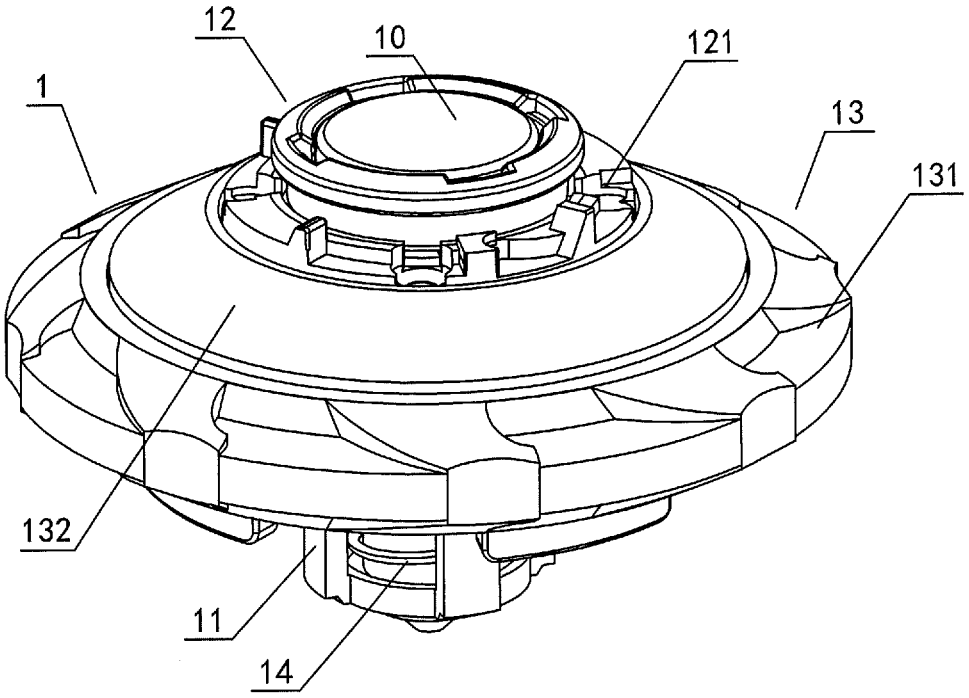
FIG. 1 is a schematic structural diagram of a mounting manner of an upper gyro according to the present invention.

As shown in FIG. 1 to FIG. 7, an automatic detachable combined toy gyro of the present invention is formed by vertically jointing at least two gyros 1, 2, and the tips of the gyros 1, 2 are all elastic tips 11, 21, so that an upper gyro 1 in the gyros 1, 2 automatically releases the connection with a lower gyro 2 when it is impacted (for example, the lower gyro 2 is impacted or the upper gyro 1 is impacted) or rotation thereof is blocked during rotation, and the upper gyro is ejected under the action of the elastic tip 11 to form two separately rotating gyros. During playing of the present invention, the upper gyro 1 is movably connected to the upper portion of the lower gyro 2, the elastic tip 11 is pressed, so that when the upper gyro 1 in the gyros is impacted or rotation thereof is blocked during rotation, the upper gyro automatically releases the connection with the lower gyro 2, and is ejected under the action of the own elastic tip 11 to form two separately rotating gyros, thereby implementing that the gyro can be split into two or three gyros during a confrontational match, which greatly increases the aggressivity of the gyro to increase the win rate, and also has a novel playing method, which is extremely interesting and can get favorites of more players. Moreover, because the tips of the gyros 1, 2 are elastic tips, during splitting and separating when playing, the upper gyro 1 is generally split by the elasticity of the tip 11 thereof, and has little impact on the lower gyro 2; in addition, when falling to the ground, the upper gyro may implement soft landing by using the buffer effect of the elasticity, so as to effectively protect the tip and maintain the stability of the rotation. Meanwhile, the elastic tip 21 of the lower gyro 2 also provides a buffer effect for the gyro, so as to prevent the impact influence and the over-heavy gyro from damaging the tip and improve the stability of the gyro; therefore, the structure is reliable, the rotation is stable, the service life is long, and the problems of the conventional toy gyro that merely one gyro is used for rotational confrontation during playing so that the win rate is low and it is less interesting, and that the gyro is instable in rotation after splitting and has a short service life, and the like are effectively solved. The present invention is generally formed by jointing two gyros. Definitely, multiple gyros may be overlapped sequentially according to a requirement. A preferred solution is two. The gyros 1, 2 may select gyros having different structures; in order that the gyro in the present invention can be ejected separately for playing, and also it is convenient to combine two or more gyros in an overlapping manner, the gyros 1, 2 generally select gyros having the same structure. Each gyro 1, 2 includes an axis body 12, 22, and a gyro ring 13, 23 sleeved on the axis body 12, 22. The elastic tip 11, 21 is connected under the axis body 12, 22, and the elastic tip 11 on the upper gyro 1 is in a compressed state when it is inserted into the axis body 22 of the lower gyro 2 to implementing jointing of the upper and lower gyros 1, 2. To implement simpler structure of the present invention, the elastic tip 11, 21 is formed by a tip body connected to a lower end of the axis body 12, 22 and provided with a spring seat in an inner cavity thereof, and a spring 14, 24 disposed on the spring seat in the inner cavity of the tip body, where an upper end of the spring 14, 24 presses against the axis body 12, 22, and when the upper gyro 1 is connected to the lower gyro 2, the spring 14 of the elastic tip 11 is compressed and retracted into the axis body 12 together with the upper tip body. To implement more convenient disconnection of the two gyros 1, 2 when they are impacted and blocked after the connection, the upper gyro 1 and the lower gyro 2 are connected into one piece in a manner that they can be separated rotatably. Moreover, there may be various connection manners between the two gyros, for example, the upper and lower gyros 1, 2 are jointed to each other by rotational clamping of the two axis bodies 12, 22; and preferably, the upper and lower gyros 1, 2 are jointed to each other by rotational clamping structures disposed on the two gyro rings 13, 23.

Figure 2:
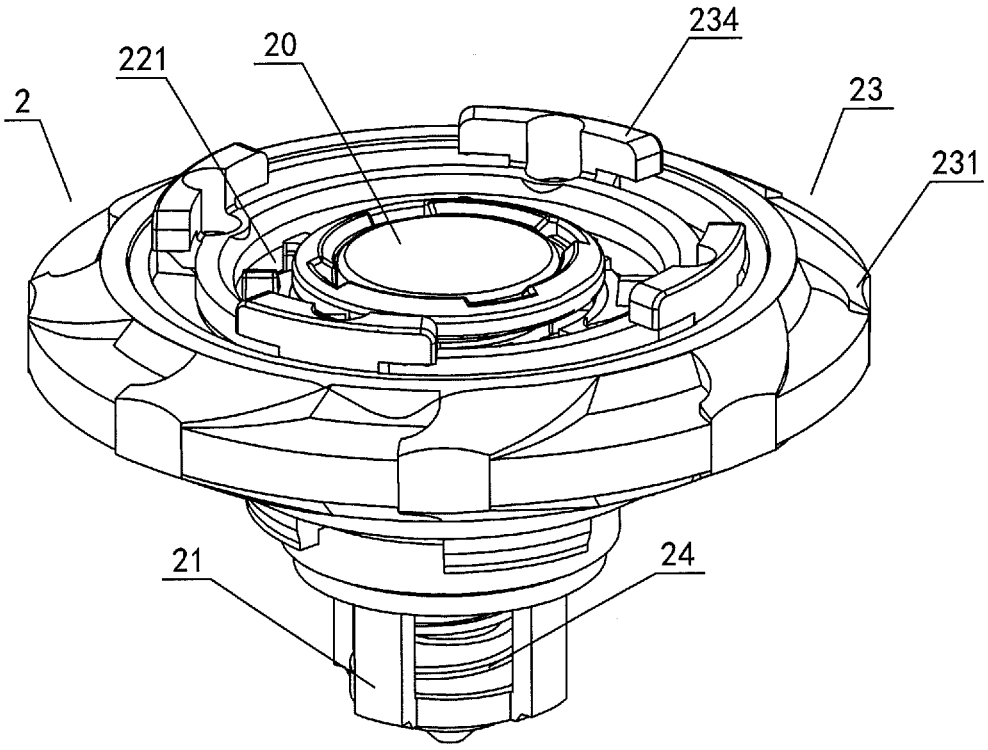
FIG. 2 is a schematic structural diagram of a mounting manner of a lower gyro according to the present invention (when two gyros have the same structure, this drawing is also a schematic structural diagram of another mounting manner of the upper gyro in FIG. 1)
Figure 3:
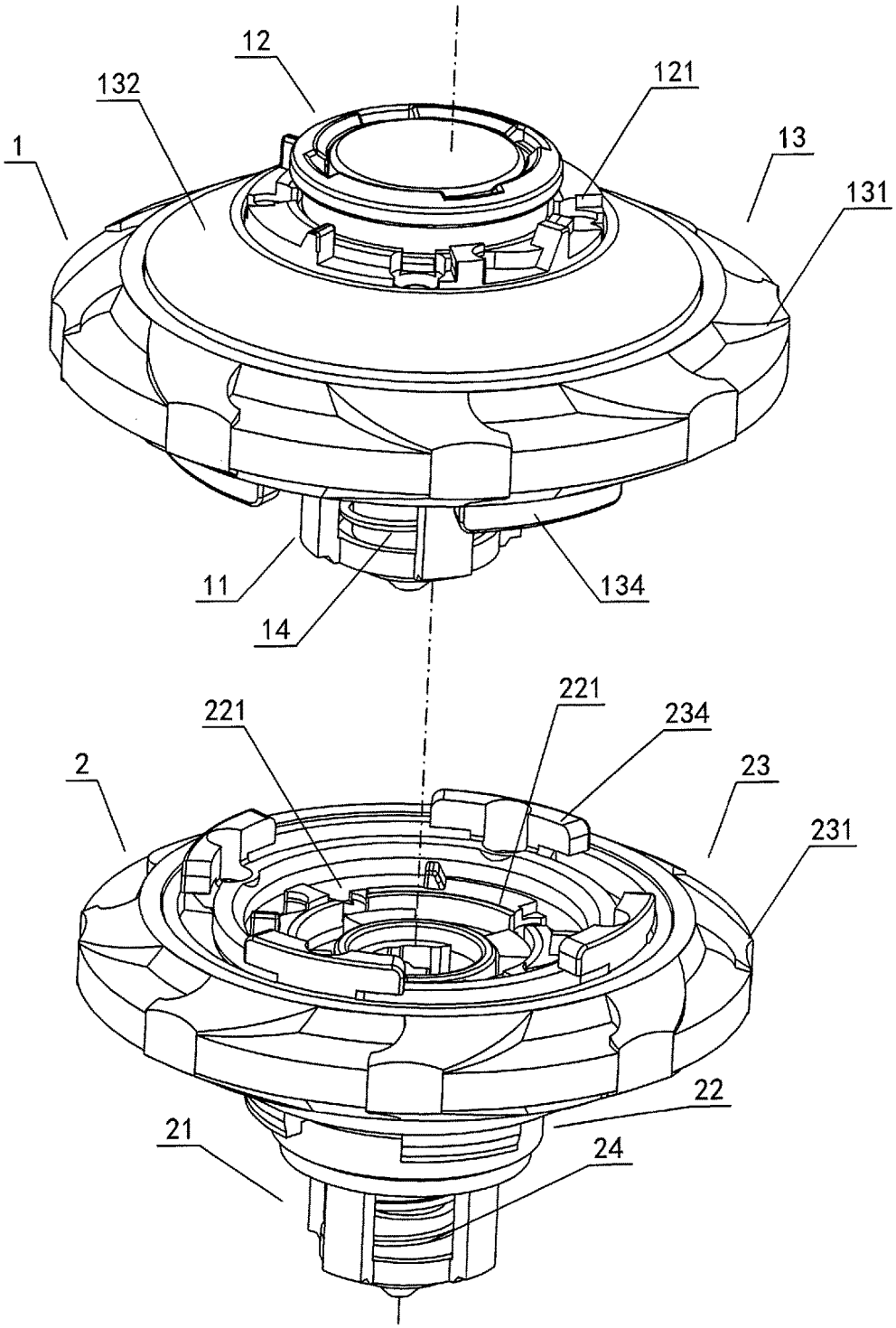
FIG. 3 is a schematic diagram of assembling FIG. 2 and FIG. 1 after a cover of the former is removed.
Figure 4:
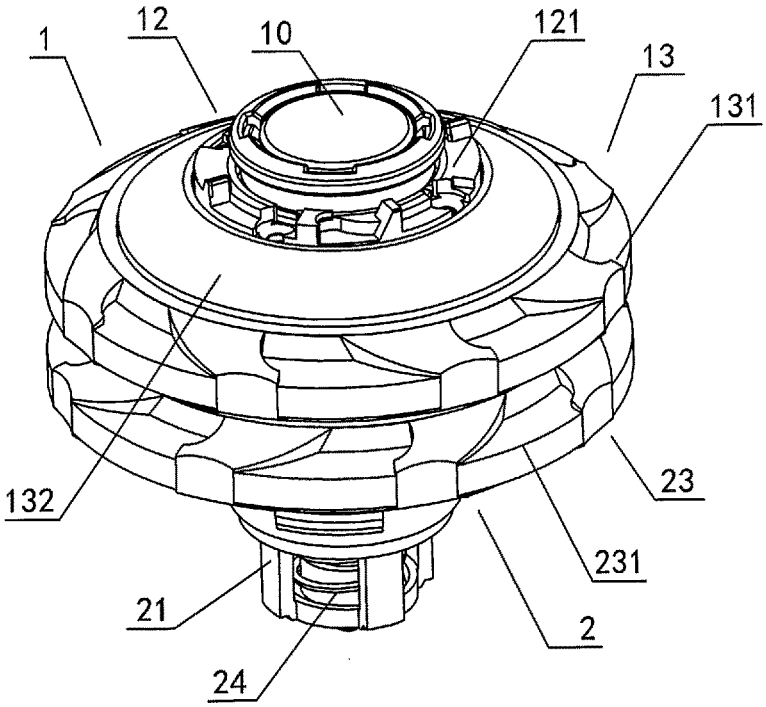
FIG. 4 is a schematic three-dimensional structural diagram of the present invention.
Figure 5:
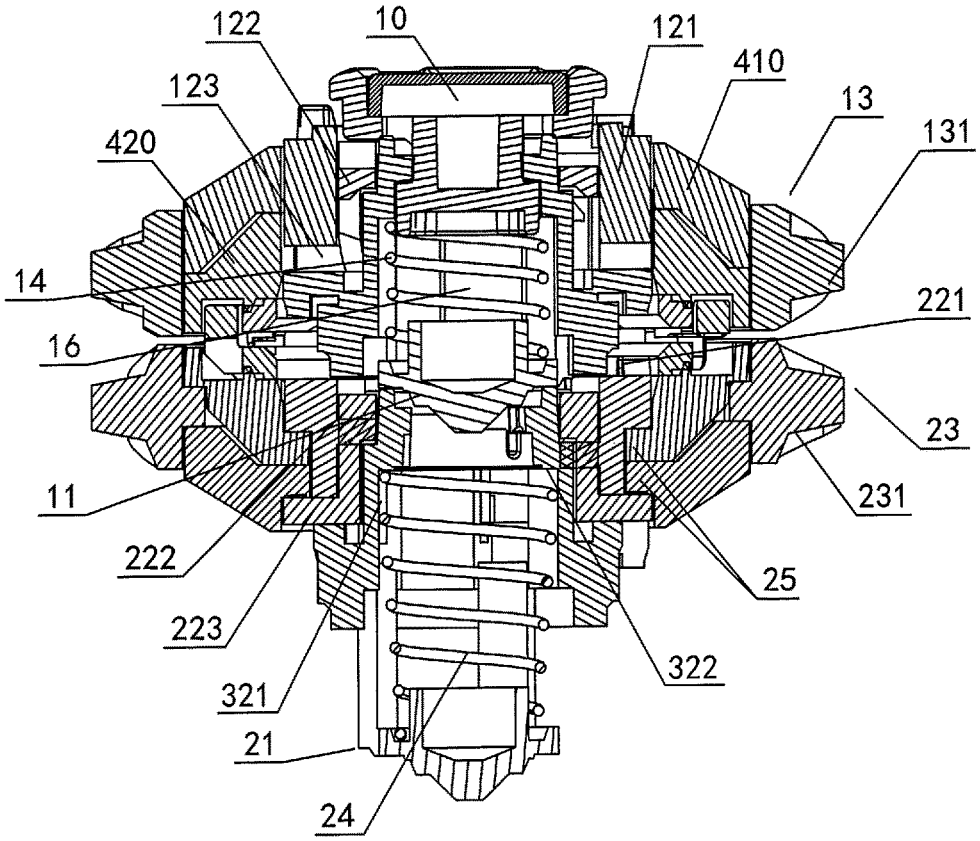
FIG. 5 is a schematic sectional structural diagram of FIG. 4.
Figure 6:
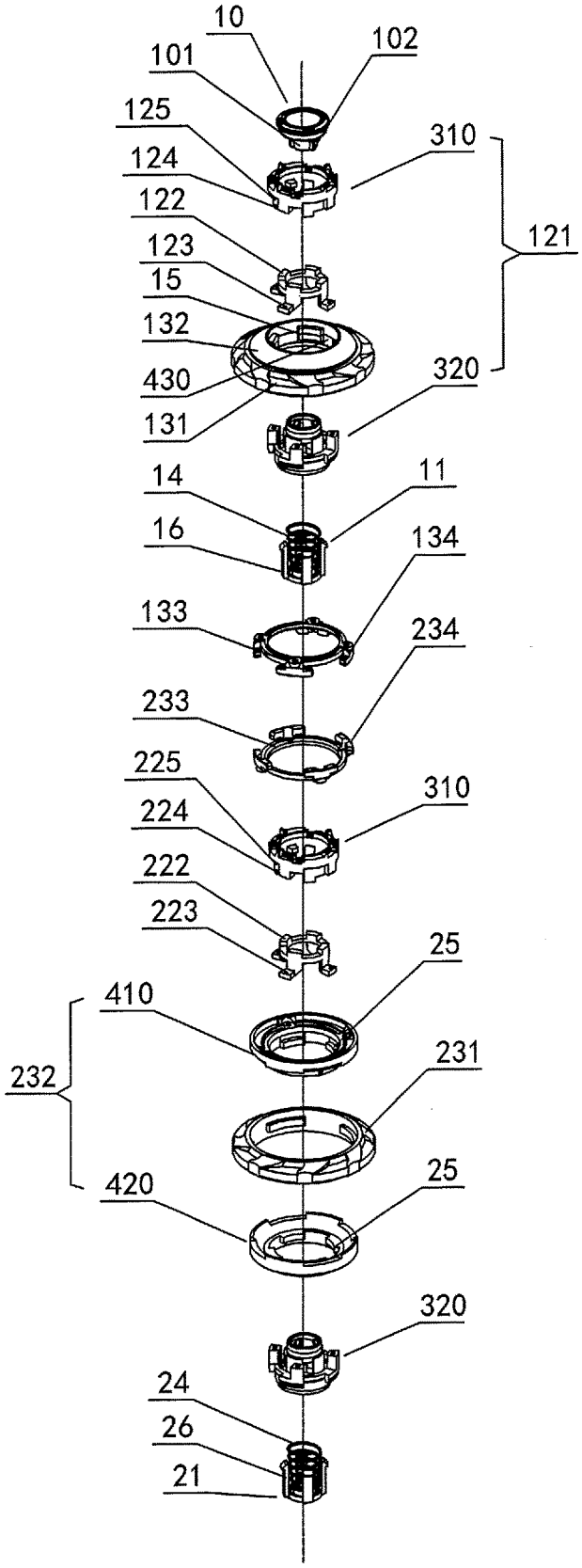
FIG. 6 is a schematic structural diagram of assembling of FIG. 4.
Figure 7:
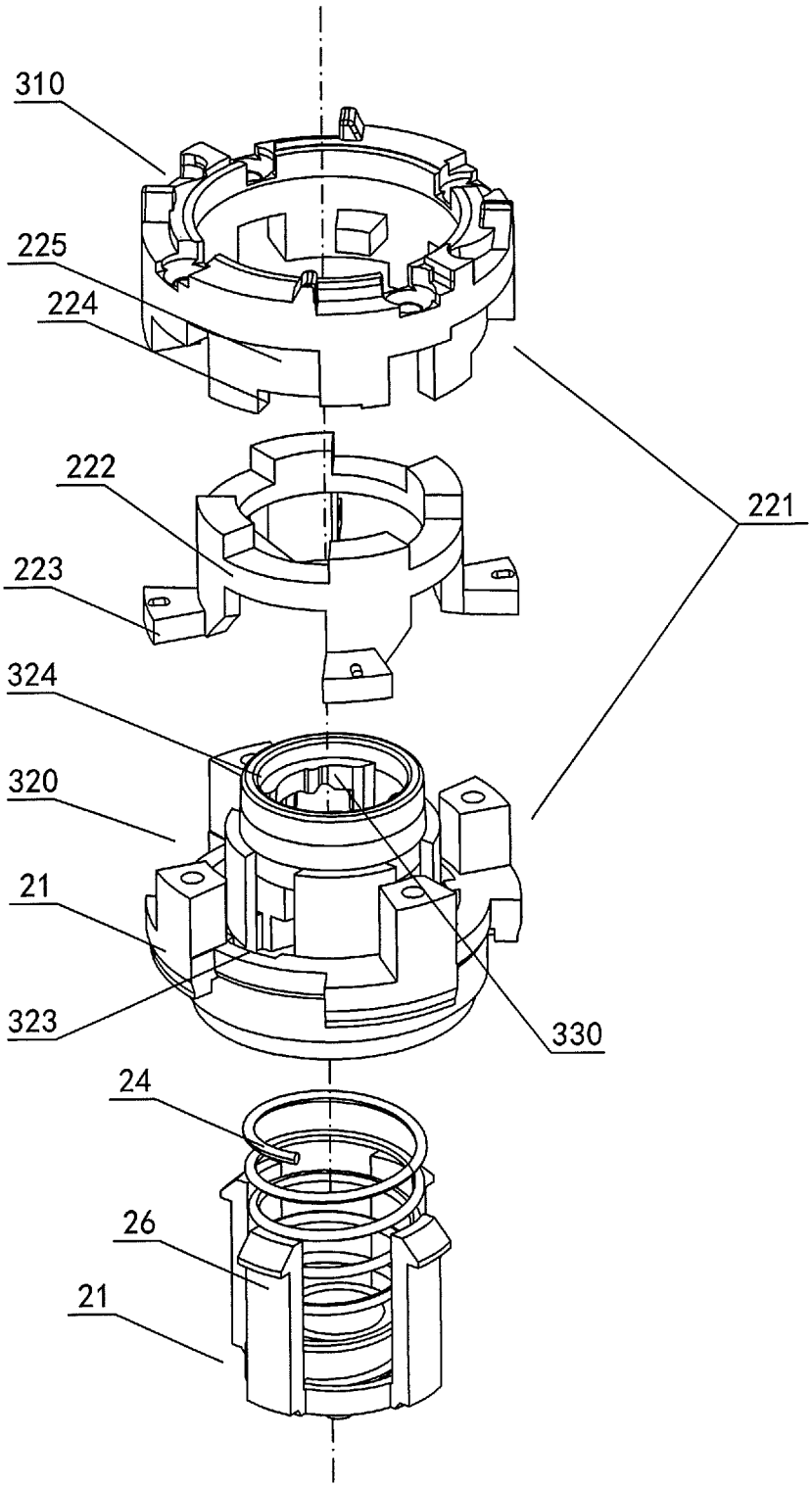
FIG. 7 is a schematic structural diagram of assembling an axis body of FIG. 3.

In order that consumers have more selections, the present invention further set that the gyros have the same structure, the upper end of the axis body 12, 22 of the gyro 1, 2 is provided with a detachable cover 10, 20, and the cover is respectively provided with a connection structure fitting an ejector. Each gyro 1, 2 may be ejected for playing by the ejector by cooperation of the connection structure on the cover and the ejector. The lower gyro 2 is jointed to the upper gyro 1 after the cover thereof is removed, where a cover mounting position disposed on the axis body 22 of the lower gyro 2 is provided with a recessed cavity for the tip of the upper gyro 1 to mount. In this way, even a consumer purchases merely one gyro, it is also valuable for playing separately, and it is unnecessary to purchase the whole combined gyro; likewise, by purchasing any one more, after combination, a function of separating or splitting when being impacted is implemented, so that it is more interesting, and has more selections. In order that the gyro ring can still be reliably combined with the axis body after the cover of the lower gyro 2 is removed, and that the assembling is more convenient, the gyro ring 13, 23 is provided with a locking structure disposed fitting the outer wall of the axis body 12, 22. In order that the structure can be conveniently detached while ensuring a reliable structure, the locking structure is a protrusion 15, 25 disposed on the inner wall of the gyro ring 13, 23. The axis body 12, 22 includes an axis sleeve 121, 221 and a clamp ring 122, 222 rotatably disposed on the axis sleeve, and the clamp ring 122, 222 is provided with a pin 123, 223 extending out of the axis sleeve 121, 221. An outer wall of the axis sleeve 121, 221 is correspondingly provided with a guide slot 124, 224 that can be penetrated by the pin 123, 223 for horizontal rotation, and a block structure 125, 225 for the protrusion 15, 25 of the gyro ring to slide in and implementing reliable connection of the gyro ring 13, 23 and the axis sleeve 121, 221 with the pressing of the pin 123, 223. The elastic tip 11, 21 is connected to a lower portion of the axis sleeve 121, 221 in a vertically movable manner. When the protrusion 15, 25 on the gyro ring 13, 23 slides into the block structure 125, 225, the clamp ring 122, 222 may be rotated so that the pin 123, 223 is rotated to be above or below the protrusion 15, 25, and therefore, the protrusion 15, 25 is reliably locked between the pin 123, 223 and one end edge of the block structure 125, 225, thereby implementing the reliable connection of the gyro ring 13, 23 and the axis body 12, 22. For further convenient machining and mounting, the axis sleeve 121, 221 includes an upper and a lower axis sleeve fitting each other, where an upper portion of the lower axis sleeve is sleeved in the upper axis sleeve, the clamp ring 122, 222 is disposed between the upper and lower axis sleeves, the upper portion of the lower axis sleeve may be fitted with a cover disposed at an upper end thereof or a bottom of an elastic tip of another gyro, and a cover lower edge of the cover or both sides of the elastic tip are disposed above the lower axis sleeve. Upper and lower limit ledges are disposed on an inner wall of the lower axis sleeve, and the tip body may be reliably connected to the lower axis sleeve in a vertically movable manner by means of hooking of a hook 16, 26 disposed thereon and the lower limit ledge of the lower axis sleeve, and an upper end of the spring 14, 24 disposed in the tip body is disposed on the upper limit ledge. When the two gyros 1, 2 are jointed vertically, the bottom of the elastic tip 11 of the upper gyro 1 is sleeved into the upper portion of the lower axis sleeve of the lower gyro 2, and a force is applied at the top of the lower axis sleeve to compress the upper elastic tip 11. In order that each axis sleeve can be reliably combined with a corresponding cover, an upper cavity wall of the lower axis sleeve may be provided with a rotation clamp structure fitting with a protrusion disposed on a lower side wall of the cover, and the rotation clamp structure is formed by a flange disposed on the upper cavity wall of the lower axis sleeve. To effectively reduce the material and processing processes of an attack ring, also leave more development room for the gyro, and to obtain a large rotation inertia, the gyro ring 13, 23 includes a circular attack ring 131, 231 having a through hole in the middle, and a screw ring 132, 232 and a clamping ring 133, 233 that are disposed fitting the attack ring 131, 231, the locking structure is disposed on the screw ring 132, 232, the rotation clamp structures is upper and lower edges 134, 234 respectively disposed on surfaces, facing each other, of the clamping rings 133, 233 of the upper and lower gyros. By overlapping the upper clamping ring 133 on the lower clamping ring 233, and rotating the upper edge 134 towards a lower portion of the lower edge 234 so that the lower edge 234 is engaged with the upper edge 134, integral connection of the upper gyro 1 and the lower gyro 2 is implemented in a rotatably detachable manner. To further enhance the reliability of the structure, the screw ring 132, 232 includes an upper cover ring and a lower cover ring disposed to fit the through hole of the attack ring 131, 231, the protrusion 15, 25 in the locking structure is formed by overlapping upper and lower flanges correspondingly disposed on the inner walls of the upper and lower cover rings. When the axis body of the gyro 12, 22 is sleeved in ring holes of the upper and lower cover rings, upper and lower flanges of the upper and lower cover rings are fit with upper and lower ends of the block structure on the axis body 12, 22 of the gyro, thereby implementing the reliable connection to the axis body 12, 22 of the gyro. In order that the attack ring 131, 231 can implement more reliable connection with the corresponding screw ring, an edge is integrally disposed on an inner wall of the through hole of the attack ring 131, 231, a notch is correspondingly disposed on the upper and lower cover rings at positions corresponding to the edge, and the upper and lower cover rings are reliably positioned on the attack ring 131, 231 by fitting of the notches and the edge. In order that the present invention can form gyros having different shape structures or gyros having different heights of the center of gravity (when the center of gravity is low, the gyro has a strong endurance; and when the center of gravity is high, the gyro can perform top attack) by assembling in different directions during use, so that the user can select different attack manners according to the characteristic of the gyro of the opposite side, the direction in which the gyro ring 13, 23 is mounted on the axis body 12, 22 may be turned over vertically. In other words, the gyro ring may be mounted on the axis body with an upper surface (a front side) facing upwards, as shown in FIG. 1; and the gyro ring may be turned over and then mounted on the axis body, that is, the gyro ring is mounted on the axis body with a lower surface (a reverse side) facing upwards, so as to form the schematic structural diagram shown in FIG. 2 (when the two gyros have the same structural composition, the lower gyro shown in FIG. 2 is another assembling manner of that in FIG. 1 after the gyro ring is turned over, and merely reference numerals are different; therefore, it is not additionally drawn). When the gyros adopt the same structure, a preferred solution of the present invention is that: the gyro ring of the lower gyro is turned over and the two gyros are jointed, so that the structure is more compact, the fighting capacity is stronger, and the appearance is better. Definitely, the two gyros can also be jointed without any turnover, and such a combined gyro has less compact structure. The present invention is smartly designed, two or more gyros are skillfully combined into one piece, and separation is implemented by confrontation and impact, so that the game is much interesting, and a player can gain a higher win rate during a match; meanwhile, the operational ability and competitiveness of children may be trained.

Although the present invention is described with reference to specific embodiments, the descriptions are not intended to limit the present invention. With reference to the descriptions of the present invention, other variations of the disclosed embodiments are expectable for a person skilled in the art, and such variations shall fall within the scope defined by the claims.

The invention claimed is:

1. An automatic detachable combined toy gyro, wherein the combined toy gyro comprises at least vertically joined upper and lower gyros each having an elastic tip, wherein the upper and lower toy gyros each comprise an axis body and a gyro ring sleeved on the axis body, each elastic tip including a tip body connected to a lower end of its associated axis body and including a spring in an inner cavity of each tip body, wherein the spring in the elastic tip of the upper gyro is in a compressed state when the tip body of the upper gyro is inserted into the axis body of the lower gyro to implement jointing of the upper and lower gyros, whereby the upper gyro in the combined gyros automatically releases its connection with the lower gyro in the combined gyros when it is impacted or rotation thereof is blocked during rotation, wherein the upper gyro is ejected from the lower gyro under an action of the spring of the elastic tip in the upper gyro to separately form a rotating upper gyro together with a rotating lower gyro.

2. The automatic detachable combined toy gyro according to claim 1, wherein the gyros have the same structure.

3. The automatic detachable combined toy gyro according to claim 1, wherein, the tip body of the upper and lower gyros includes a spring seat in the inner cavity, and the spring is disposed on the spring seat, wherein an upper end of the spring is pressed against the axis body, and wherein when the upper gyro is connected to the lower gyro, the spring of the elastic tip is compressed and retracted into the axis body together with the tip body of the upper gyro.

4. The automatic detachable combined toy gyro according to claim 3, wherein when the upper gyro and the lower gyro are connected into one piece, the upper and lower gyros are connected to each other by either rotational clamping structures disposed on two gyro rings or are connected to each other by a rotational clamping of two axis bodies.

5. The automatic detachable combined toy gyro according to claim 3, wherein, an upper end of the axis body of each gyro includes a detachable cover, each cover including a connection structure fitting an ejector, and each gyro is adapted to be ejected by the ejector by cooperation of the connection structure on the cover and the ejector; the lower gyro is connected to the upper gyro after the cover is removed, wherein the axis body of the lower gyro is provided with a recessed cavity to receive the tip of the upper gyro.

6. The automatic detachable combined toy gyro according to claim 4, wherein, the gyro ring includes a locking structure disposed fitting an outer wall of the axis body.

7. The automatic detachable combined toy gyro according to claim 6, wherein, the locking structure includes a protrusion provided on an inner wall of the gyro ring, the axis body including an axis sleeve and a clamp ring rotatably disposed on the axis sleeve, the clamp ring including a pin extending out of the axis sleeve, an outer wall of the axis sleeve correspondingly including a guide slot configured to be penetrated by the pin for horizontal rotation, and a block structure for the protrusion of the gyro ring to slide in and to connect the gyro ring and the axis sleeve upon pressing of the pin, the elastic tip connected to a lower portion of the axis sleeve in a vertically movable manner, when the protrusion on the gyro ring slides into the block structure, the clamp ring may be rotated so that the pin is rotated to be above or below the protrusion, whereby the protrusion is locked between the pin and an end edge of the block structure, thereby connecting of the gyro ring and the axis body.

8. The automatic detachable combined toy gyro according to claim 7, wherein, the axis sleeve comprises an upper and a lower axis sleeve fitting each other, wherein an upper portion of the lower axis sleeve is sleeved in the upper axis sleeve, the clamp ring is disposed between the upper and lower axis sleeves, the upper portion of the lower axis sleeve is configured to be fitted with a cover disposed at an upper end thereof or a bottom of an elastic tip of another gyro, and a cover lower edge of the cover or both sides of the elastic tip are disposed above the lower axis sleeve.

9. The automatic detachable combined toy gyro according to claim 8, wherein, upper and lower limit ledges are disposed on an inner wall of the lower axis sleeve, and the tip body is configured to be connected to the lower axis sleeve in a vertically movable manner by means of hooking of a hook disposed thereon and the lower limit ledge of the lower axis sleeve, and an upper end of the spring disposed in the tip body is disposed on the upper limit ledge, wherein when the two gyros are jointed vertically, the bottom of the elastic tip of the upper gyro is sleeved into the upper portion of the lower axis sleeve of the lower gyro , and a force applied at the top of the lower axis sleeve compresses the upper elastic tip.

10. The automatic detachable combined toy gyro according to claim 9, wherein, an upper cavity wall of the lower axis sleeve includes a rotation clamp structure fitting with a protrusion disposed on a lower side wall of the cover, and the rotation clamp structure is formed by a flange disposed on the upper cavity wall of the lower axis sleeve.

11. The automatic detachable combined toy gyro according to claim 7, wherein, the gyro ring comprises a circular attack ring having a through hole in the middle, and a screw ring and a clamping ring disposed to fit the attack ring, the locking structure disposed on the screw ring, the rotational clamp structures comprise upper and lower edges respectively disposed on surfaces, facing each other, of the clamping rings of the upper and lower gyros; whereby overlapping the upper clamping ring on the lower clamping ring, and rotating the upper edge towards a lower portion of the lower edge so that the lower edge is engaged with the upper edge implements integral connection of the upper gyro and the lower gyro in a rotatably detachable manner.

12. The automatic detachable combined toy gyro according to claim 11, wherein, the screw ring comprises an upper cover ring and a lower cover ring disposed to fit the through hole of the attack ring, the protrusion in the locking structure formed by overlapping upper and lower flanges correspondingly disposed on the inner walls of the upper and lower cover rings; wherein when the axis body of the gyro is sleeved in ring holes of the upper and lower cover rings, upper and lower flanges of the upper and lower cover rings are fit with upper and lower ends of the block structure on the axis body of the gyro, thereby implementing connection to the axis body of the gyro.

13. The automatic detachable combined toy gyro according to claim 12, wherein, an edge is integrally disposed on an inner wall of the through hole of the attack ring, a notch is correspondingly disposed on the upper and lower cover rings at positions corresponding to the edge, and the upper and lower cover rings are positioned on the attack ring by fitting of the notches and the edge.

14. The automatic detachable combined toy gyro according to claim 1, wherein the direction in which the gyro ring is mounted on the axis body may be turned over vertically.

15. The automatic detachable combined toy gyro according to claim 11, wherein the direction in which the gyro ring is mounted on the axis body may be turned over vertically.

16. The automatic detachable combined toy gyro according to claim 12, wherein the direction in which the gyro ring is mounted on the axis body may be turned over vertically.

17. The automatic detachable combined toy gyro according to claim 13, wherein the direction in which the gyro ring is mounted on the axis body may be turned over vertically.

18. An automatic detachable combined toy gyro, wherein the combined toy gyro comprises at least vertically joined upper and lower gyros each having an elastic tip, wherein the upper and lower toy gyros each comprise an axis body and a gyro ring sleeved on the axis body, each elastic tip including a tip body connected to a lower end of its associated axis body and including a spring in an inner cavity of each tip body, wherein the spring in the elastic tip of the upper gyro is in a compressed state when the tip body of the upper gyro is inserted into the axis body of the lower gyro to implement jointing of the upper and lower gyros, whereby the upper gyro in the combined gyros automatically releases its connection with the lower gyro in the combined gyros when it is impacted or rotation thereof is blocked during rotation, wherein the upper gyro is ejected from the lower gyro under an action of the spring of the elastic tip in the upper gyro to separately form a rotating upper gyro together with a rotating lower gyro; and wherein, an upper end of the axis body of each gyro includes a detachable cover, each cover including a connection structure fitting an ejector, and each gyro is adapted to be ejected by the ejector by cooperation of the connection structure on the cover and the ejector; the lower gyro is connected to the upper gyro after the cover is removed, wherein the axis body of the lower gyro is provided with a recessed cavity to receive the tip of the upper gyro.

19. An automatic detachable combined toy gyro, wherein the combined toy gyro comprises at least vertically joined upper and lower gyros each having an elastic tip, wherein the upper and lower toy gyros each comprise an axis body and a gyro ring sleeved on the axis body, each elastic tip including a tip body connected to a lower end of its associated axis body and including a spring in an inner cavity of each tip body, wherein the spring in the elastic tip of the upper gyro is in a compressed state when the tip body of the upper gyro is inserted into the axis body of the lower gyro to implement jointing of the upper and lower gyros, whereby the upper gyro in the combined gyros automatically releases its connection with the lower gyro in the combined gyros when it is impacted or rotation thereof is blocked during rotation, wherein the upper gyro is ejected from the lower gyro under an action of the spring of the elastic tip in the upper gyro to separately form a rotating upper gyro together with a rotating lower gyro; and wherein when the upper gyro and the lower gyro are connected into one piece, the upper and lower gyros are connected to each other by either rotational clamping structures disposed on two gyro rings or are connected to each other by a rotational clamping of two axis bodies; wherein, the gyro ring includes a locking structure disposed fitting an outer wall of the axis body; and wherein, the locking structure includes a protrusion provided on an inner wall of the gyro ring, the axis body including an axis sleeve and a clamp ring rotatably disposed on the axis sleeve, the clamp ring including a pin extending out of the axis sleeve, an outer wall of the axis sleeve correspondingly including a guide slot configured to be penetrated by the pin for horizontal rotation, and a block structure for the protrusion of the gyro ring to slide in and to connect the gyro ring and the axis sleeve upon pressing of the pin, the elastic tip connected to a lower portion of the axis sleeve in a vertically movable manner, when the protrusion on the gyro ring slides into the block structure, the clamp ring may be rotated so that the pin is rotated to be above or below the protrusion, whereby the protrusion is locked between the pin and an end edge of the block structure, thereby connecting of the gyro ring and the axis body.

* * * * *